US007819270B1

(12) United States Patent
Hughes

(10) Patent No.: US 7,819,270 B1
(45) Date of Patent: Oct. 26, 2010

(54) TELESCOPING MATERIAL HANDLING BIN

(76) Inventor: Michael R. Hughes, 3200 Cottonwood La., Berthoud, CO (US) 80513

( * ) Notice: Subject to any disclaimer, the term of this patent is extended or adjusted under 35 U.S.C. 154(b) by 301 days.

(21) Appl. No.: 12/033,048

(22) Filed: Feb. 19, 2008

Related U.S. Application Data

(60) Provisional application No. 60/950,641, filed on Jul. 19, 2007.

(51) Int. Cl.
*B65D 6/28* (2006.01)
*B65D 6/00* (2006.01)

(52) U.S. Cl. ..... 220/8; 220/6; 220/7; 220/4.03; 220/4.21

(58) Field of Classification Search ..... 220/6–8, 220/4.03, 4.21, 608; 414/373, 400, 398, 414/525.9
See application file for complete search history.

(56) References Cited

U.S. PATENT DOCUMENTS

| | | | | |
|---|---|---|---|---|
| 876,235 | A * | 1/1908 | Quackenboss | 47/66.1 |
| 3,179,278 | A * | 4/1965 | Cohen | 220/8 |
| 3,868,155 | A | 2/1975 | Cherubini | |
| 4,211,033 | A | 7/1980 | Ringer | |
| 4,923,356 | A * | 5/1990 | Foster | 414/373 |
| 4,990,048 | A * | 2/1991 | Foster | 414/398 |
| 5,011,103 | A | 4/1991 | Hayes et al. | |
| 5,163,278 | A | 11/1992 | Martenhoff et al. | |
| 5,191,989 | A | 3/1993 | Butler | |
| 5,192,019 | A * | 3/1993 | Meehan | 229/101 |
| 5,449,083 | A | 9/1995 | Dougherty et al. | |
| 5,875,912 | A * | 3/1999 | Hobson | 220/4.03 |
| 6,019,239 | A | 2/2000 | Watson | |
| 6,536,846 | B1 | 3/2003 | Felty | |
| 6,691,884 | B1 * | 2/2004 | Dwyer | 220/4.03 |
| 6,874,797 | B2 | 4/2005 | Gardenour | |
| 6,910,574 | B2 | 6/2005 | Straka | |
| 7,080,653 | B2 | 7/2006 | Zheng | |
| 7,175,205 | B2 | 2/2007 | Simpson | |
| 7,367,467 | B2 * | 5/2008 | Bashuk | 220/4.03 |
| 2004/0208734 | A1 * | 10/2004 | Shoemyer et al. | 414/607 |
| 2008/0265010 | A1 * | 10/2008 | Montague Kisch | 229/122.32 |

* cited by examiner

*Primary Examiner*—Anthony Stashick
*Assistant Examiner*—Kareen Rush
(74) *Attorney, Agent, or Firm*—Rick Martin; Patent Law Offices of Rick Martin, P.C.

(57) ABSTRACT

A bulk materials bin is able to contain heavy landscape materials such as gravel. A base has a box shape with an open front along a long side. U shaped side panels nest inside the base for transport. In the extended mode some or all of the side panels are lifted from the base to a desired depth of the bin. Bolts secure the side panels together. Side struts prevent bowing and slipping of bins. A retractable ramp allows front loader to enter the bin for loading/unloading. A lifting bar provides loading/unloading of bins and can lock into place to provide secure storage area for equipment.

5 Claims, 6 Drawing Sheets

TELESCOPING MATERIAL HANDLING BIN

CROSS REFERENCE APPLICATIONS

This application is a non-provisional application claiming the benefits of provisional application No. 60/950,641 filed Jul. 19, 2007.

FIELD OF INVENTION

The present invention relates to constructing a gravel/construction material bin of metal, wherein the sides telescope down to within the width of a trailer for transport.

BACKGROUND OF THE INVENTION

Landscape construction sites often lack storage for bulk materials thereon such as gravel, dirt, mulch and rocks. These materials may be landscaping materials for large projects such as office buildings. Currently no storage containers for bulk materials transfer exists. Unless built from plywood, bins are built and torn down from jobsite to jobsite. This is a waste of labor and materials.

What is needed in the art is a portable bulk material bin that can be trailored from jobsite to jobsite. The bin must be expandable to a width greater than an eight foot trailer or delivery truck to be useful for storing large loads of bulk materials.

The present invention solves this need with a series of nested U shaped bin segments. When nested the assembly fits on a trailer. When expanded and bolted together, the U shaped bin segments form a large, sturdy bulk material bin. By selecting the number of segments chosen, the user creates the depth of the bulk material bin that he needs.

SUMMARY OF THE INVENTION

An aspect of the present invention is to provide a rugged bin for holding landscape materials such as gravel to allow a front loading tractor to add and remove the materials from an open end of the bin.

Another aspect of the present invention is to provide a nesting of lateral segments of the bin so the bin can fit on a trailer for transport, and then be quickly expanded to a chosen depth at a jobsite.

Another aspect of the present invention is to provide a ramp and bin opening at the open end of the bin sized to accommodate a tandem axle truck, whereas such a truck can be backed completely inside the container to deposit its load.

Another aspect of the present invention is to provide an anti-bowing strut(s) along the sides of the bin segments.

Another aspect of the present invention is to provide a means for a forklift to raise/lower the nested assembly of the bin.

Other aspects of this invention will appear from the following description and appended claims, reference being made to the accompanying drawings forming a part of this specification wherein like reference characters designate corresponding parts in the several views.

A rectangular box made of a heavy duty steel, forms the base/backend of the bin. The base has an open top and an open side facing forward. A flange along the top of each side receives at least one U shaped side segment in a nested manner. When nested the assembly fits on a trailer for transport.

At the jobsite a fork lift raises the bin assembly off the trailer and places it where needed. Then the segments are pulled out from the base to the desired length of the bin.

Bolts fasten the extended segments together along the top. Hinged side struts are extended out from the sides to prevent excessive bowing. An optional ramp is folded down from a storage position at the open front of the bin.

Finally the arm which is used to lift the bins, can be locked into place across the front of the bin to provide a secure place to park equipment at job sites. The equipment can be parked inside the bin, unable to be driven out.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
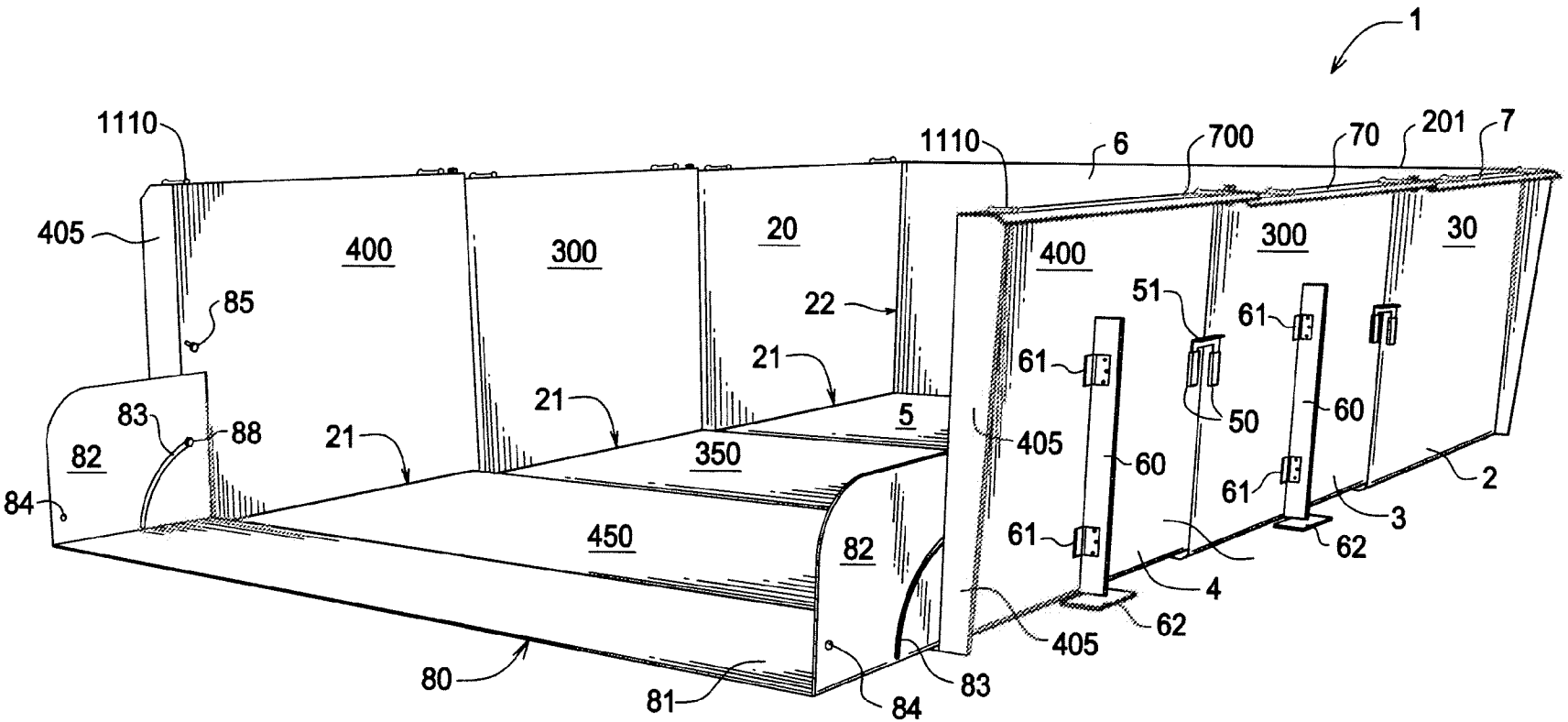
FIG. 1 is a front perspective view of an extended bin having two side panels.

Referring first to FIG. 1 an extended mode bin 1 is shown to have a base segment 2, a first side panel 3, and second side panel 4. The base segment 2 has a bottom 5, a vertical rear panel 6, and pair of opposing side panels 20, 30. A top flange 7 is mounted along the top side of side panels 20, 30. The seams at 21, 22 could be bend seams from a single sheet of sheet metal, or weld seams between two separate sheet metal sheets.

Figure 10:
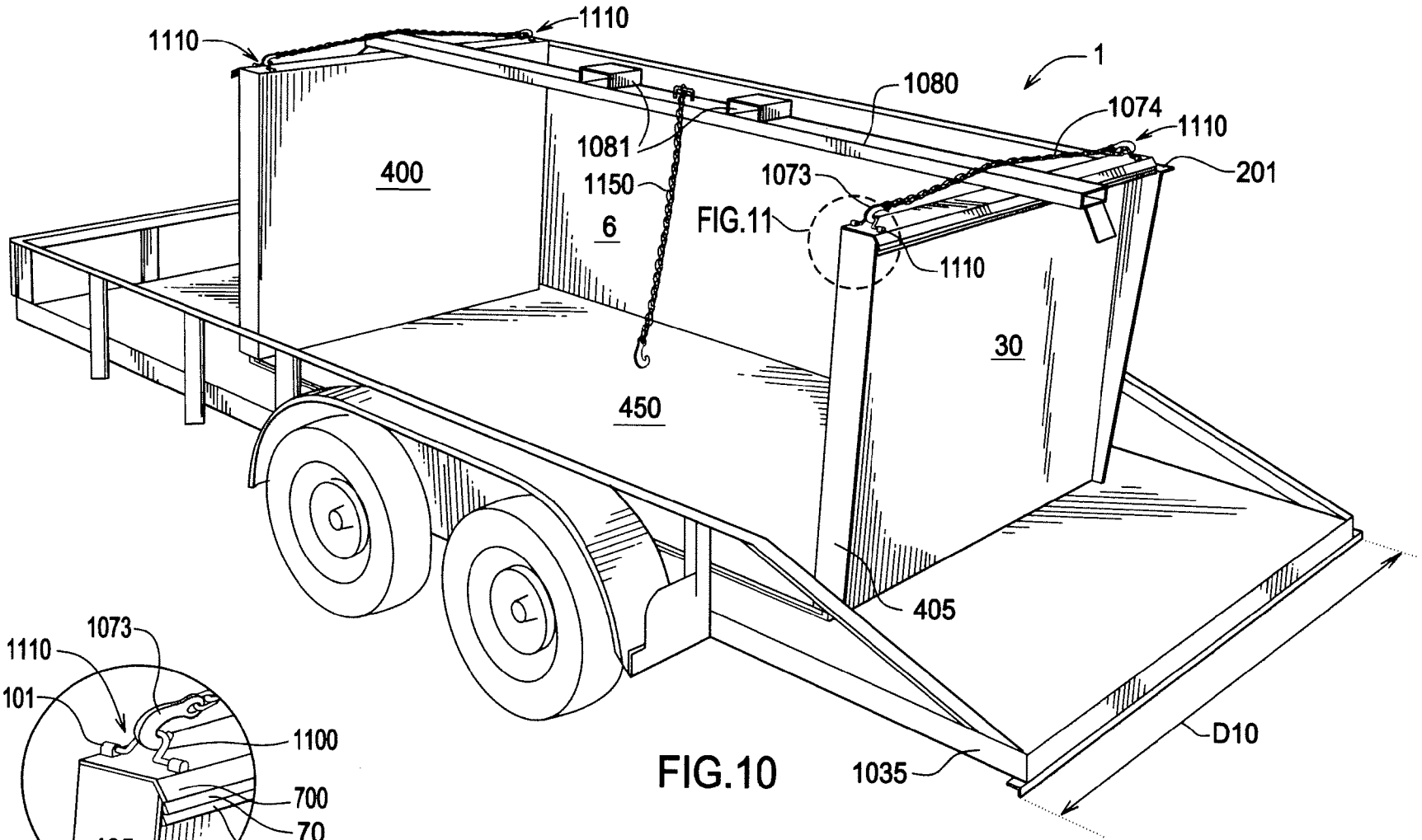
FIG. 10 is a rear perspective view of a trailer loaded with the nested mode of the FIG. 8 embodiment.

Side panel 3 is slightly narrower than base 2 and can be nested inside base 2 as shown in FIG. 10. Side panel 3 consists of a bottom 350 and opposing sides 300. Flange 70 slides over flange 7 in the nested mode shown in FIG. 10.

Side panel 4 consists of bottom 450 and opposing sides 400. Covers 405 provide end support and protect the nested side panels in the nested mode. Flange 700 slide over flanges 7, 70 in the nested mode.

Pockets 50 receive the locking fork 51 to secure the adjacent side panels together in the extended mode shown in FIG. 1. Hinges 61 support struts 60 to be extended to prevent bowing in the extended mode. Plates 62 are placed under struts 60. The struts 60 are folded against the sides 300, 400 in the nested mode.

A ramp 80 has a floor 81 which is supported by side panels 82. A slot 83 allows a rivet 88 to guide the ramp 80 up to a retracted position for transport. A bolt 85 goes thru hole 84 to lock the ramp 80 into the retracted position.

Figure 2:
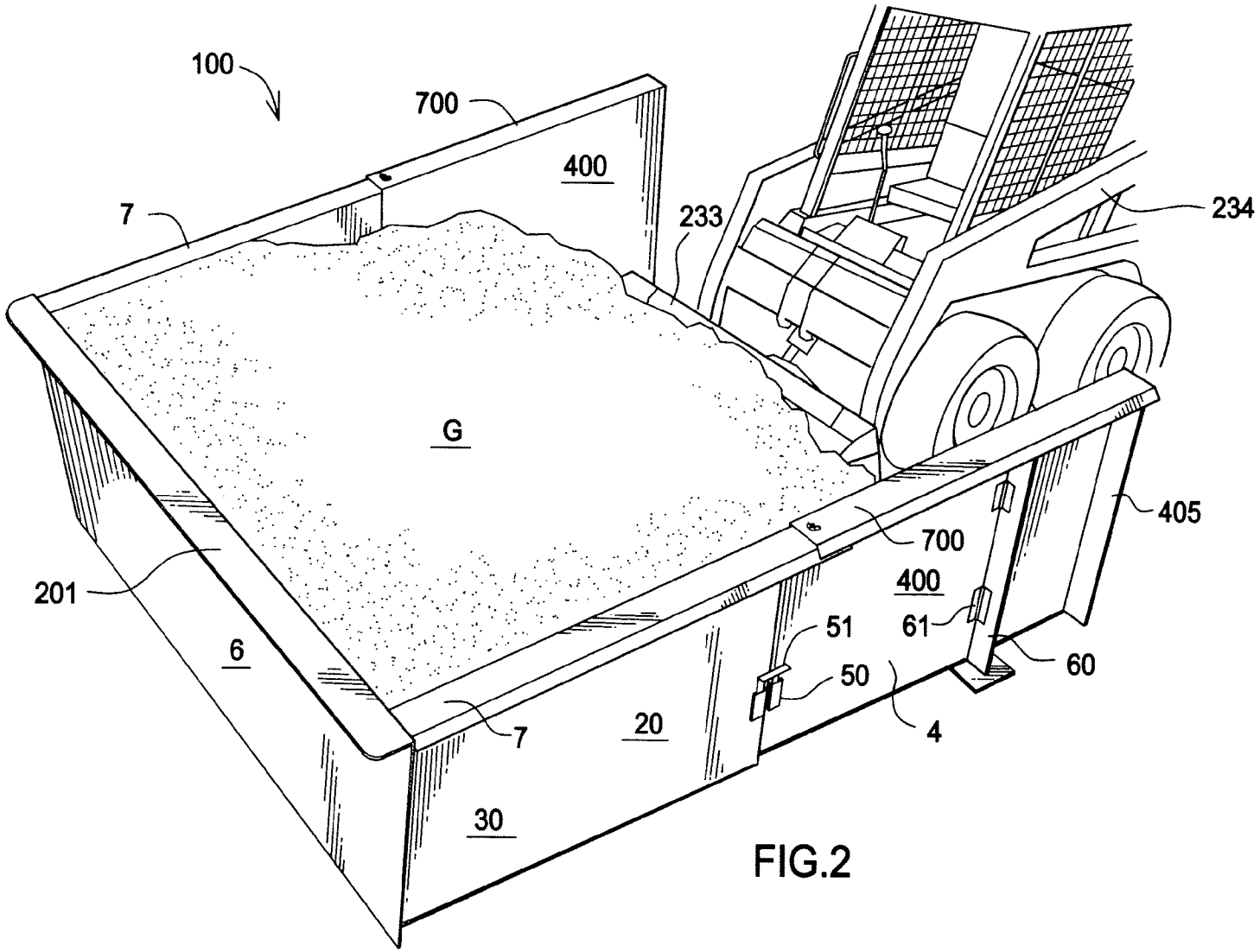
FIG. 2 is a top perspective view of a bin having one side panel.

FIG. 2 shows a one side panel bin 100 in the extended position. A side panel 4 is extended. Gravel G is being scooped up by the shovel 233 of tractor 234.

Figure 3:
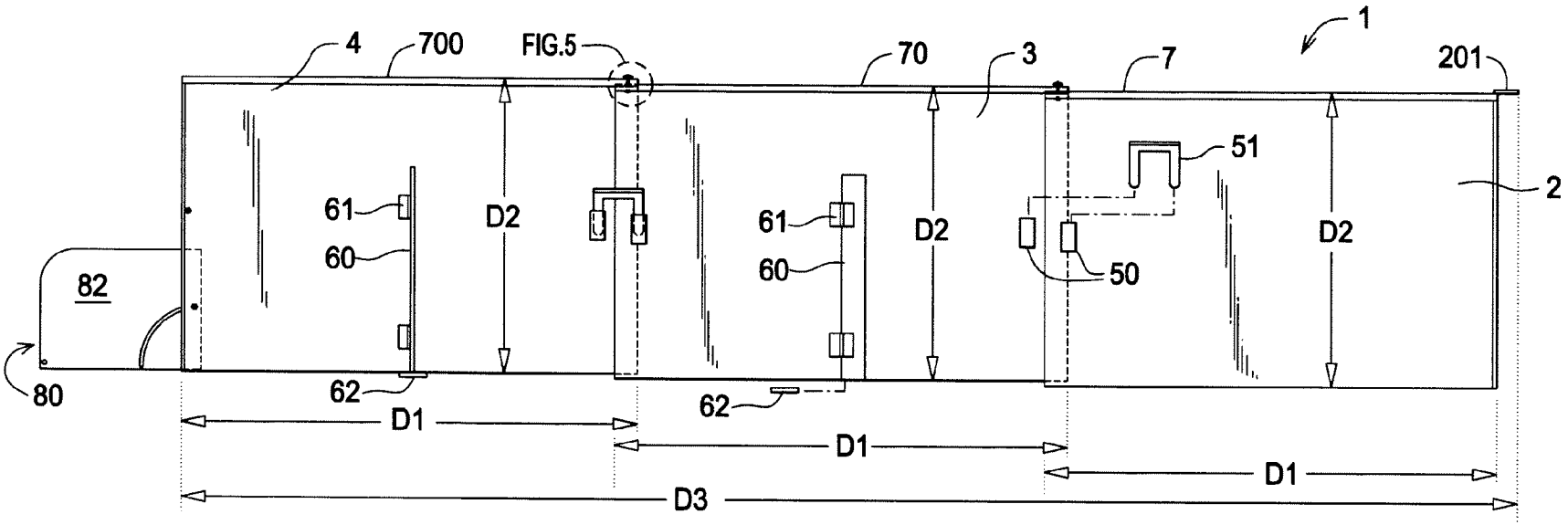
FIG. 3 is a side plan view of the FIG. 1 embodiment.

FIG. 3 shows the bins 1 in the extended mode as show in FIG. 1. The full depth D3 can be chosen by the user. A trailer width of eight feet or less for dimension D1 is usually controlling. Dimension D2 is nominally four feet, but is totally dependent on the user's needs. Ledge 201 is generally welded to flange 7 for support.

Figure 5:
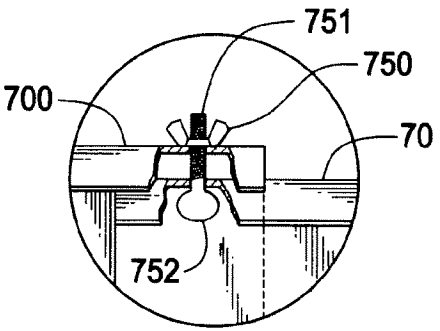
FIG. 5 is a close up view of the bolted joint between the side panels.
Figure 4:
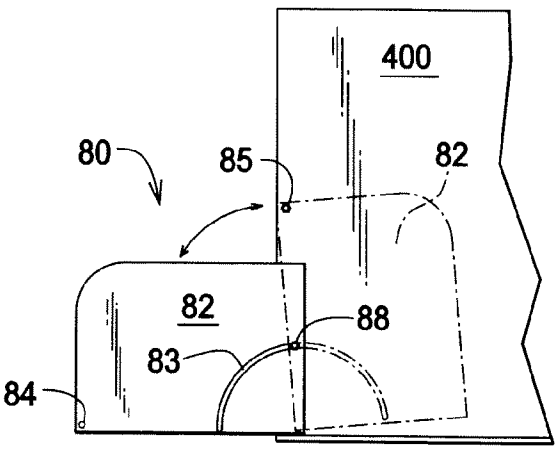
FIG. 4 is a close up view of the folding ramp.

FIGS. 4, 5 show adjacent side panels 3, 4 with flanges 70, 700 respectively to have a locking hole filled with bolt 751. Bolt 751 has a head 752 and wing nut 750 for a quick, no tools required setup. The dotted lines view of side 82 shows the ramp 80 in the retracted position.

Figure 6:
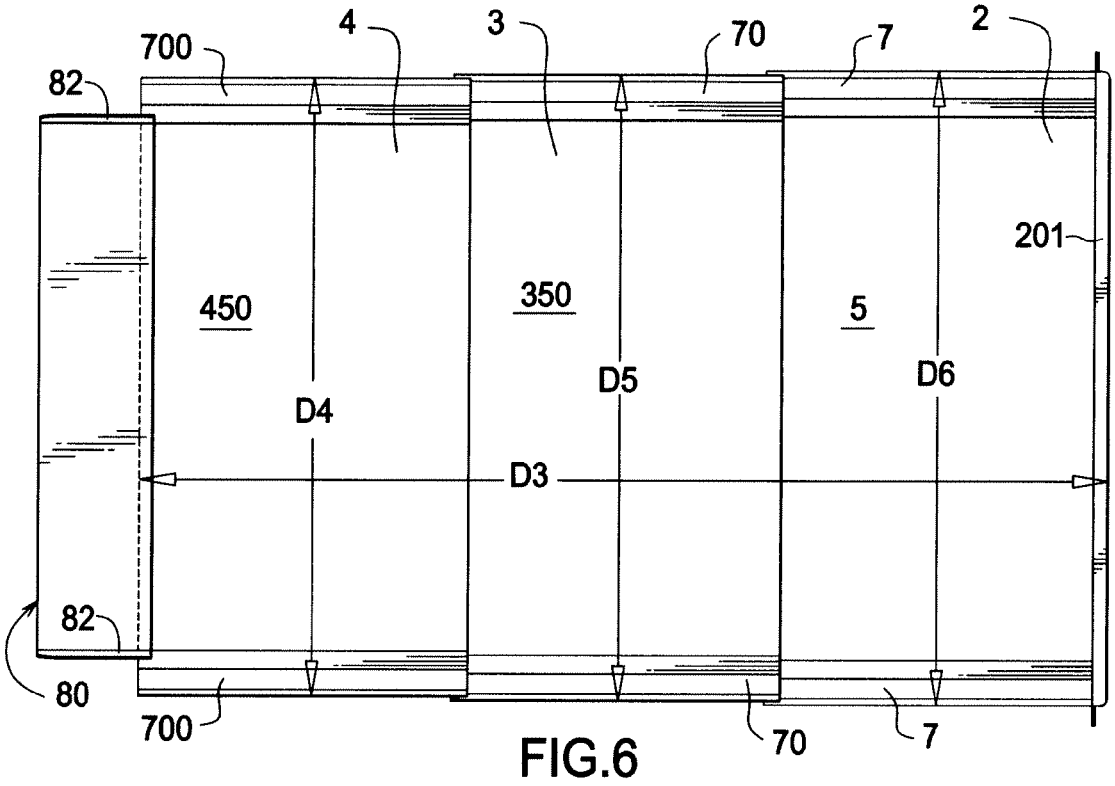
FIG. 6 is a top plan view of the FIG. 1 embodiment.
Figure 7:
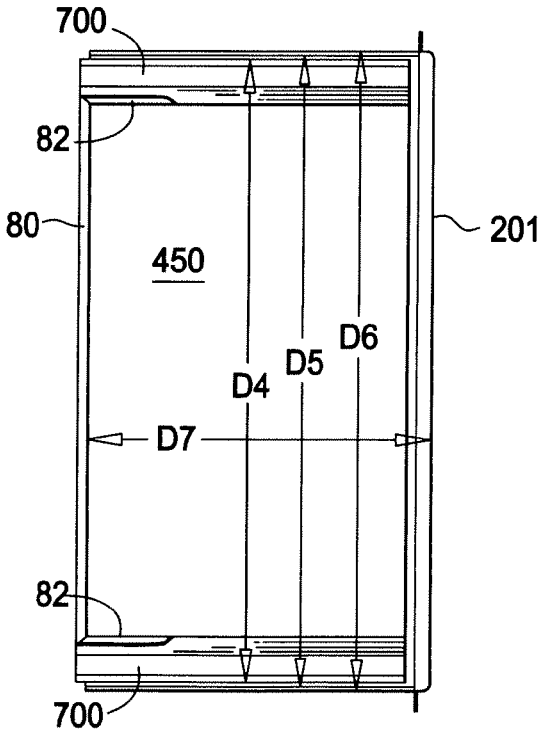
FIG. 7 is a top plan view of the nested mode of the FIG. 1 embodiment.

In FIGS. 6, 7 base 2 needs to be slightly wider than side panel 3, wherein D6>D5>D4. D7 will be about the same as D1 of FIG. 3 so as to fit on a trailer as shown in FIG. 10.

Figure 8:
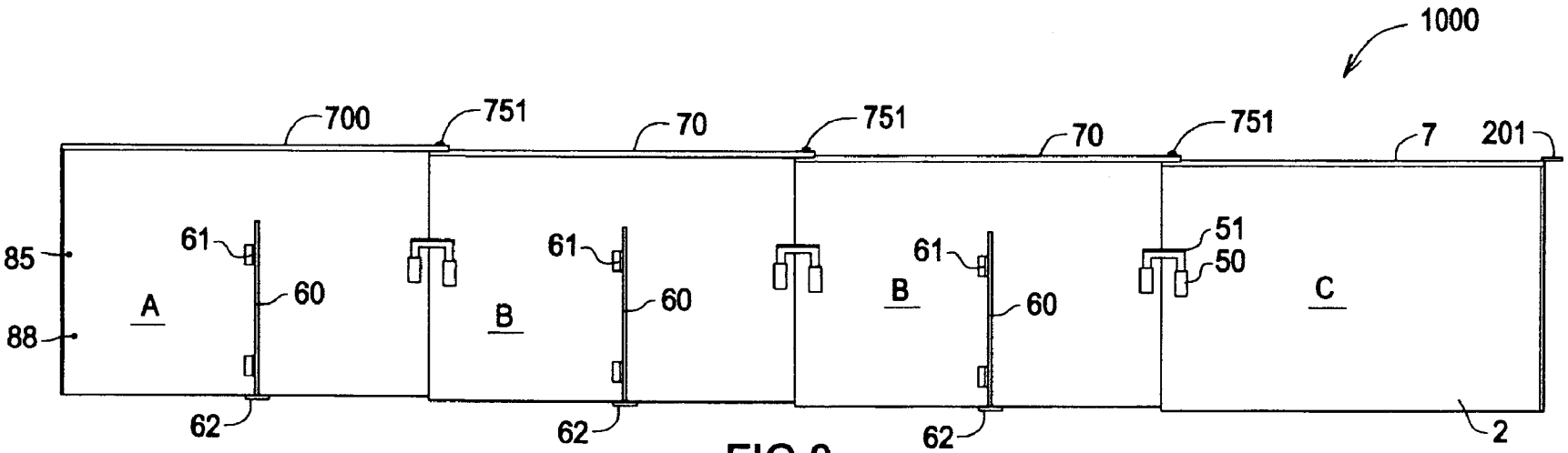
FIG. 8 is a side plan view of a three side panel bin extended.
Figure 9:
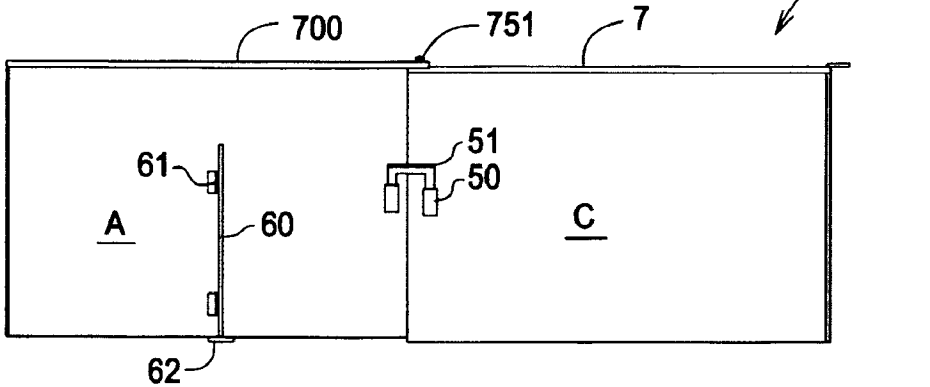
FIG. 9 is the same view as FIG. 8 with two of the side panels labeled B nested into the base labeled C or stored elsewhere.

In FIG. 8 an extended bin 1000 has a base C, two side panels B and a front side panel A. FIG. 9 shows the bin 1000 in use with the two side panels B nested into base C or stored elsewhere. Thus, a variety of bin depths can be created for different jobsites by adding or subtracting sections. Flange 7000 covers flanges 700, 70, 7. Normally each side panel is lifted (not slid) into position.

Figure 11:
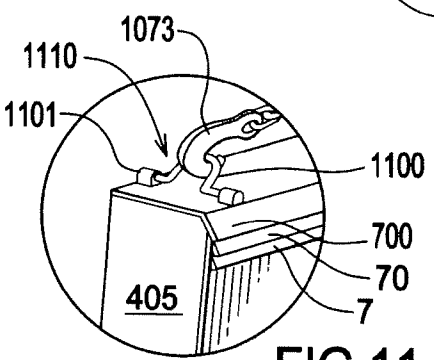
FIG. 11 is a close up view of the chain and anchor used to lift a side panel(s) out of the trailer.

Referring last to FIGS. 10, 11 a trailer 1035 has a width D10≧D7 shown in FIG. 7. The nested bin 1 has a cover 405. A hook 1073 may lock into hole in the cover 405 (hole not shown) for transport. Preferably a chain 1074 runs across flange 700 to a front and rear anchor ring 1110. Attachment rings 1110 reach at section corner. The chain 1074 can provide a lift strap for beam 1080, wherein a forklift can engage brackets 1081 for lifting uppermost bin 400 and optionally additional bins. Each anchor ring 1110 consists of a pair of bases 1101 and pivotable ring 1100. A safety chain 1150 attaches from the beam 1000.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A nestable bulk storage bin, said bin comprising:

a base segment having a bottom, a vertical rear panel attached to the bottom and an open top;

a pair of opposing sides each attached to the bottom, and the base segment having an open end opposite the vertical rear panel;

said opposing sides having a parallel relationship and a separation distance, width W1;

a side panel having generally a U shape and having a nested mode inside the base segment and an extended mode outside the base segment;

said side panel having a bottom with a width slightly narrower than W1;

said side panel having a pair of sides attached to its bottom, in a parallel relationship to each other and having an open top, front and rear;

wherein the side panel in the extended mode has a locking means functioning to lock its sides to the respective sides of the base segment, thereby forming a continuous bottom from the vertical rear panel to the front of the side panel and forming continuous, parallel sides from the vertical rear panel to the front of the side panel;

wherein the locking means further comprises a pocket on the outside of each adjoining side and a horseshoe shaped locking fork secured into the pockets in a downward fashion;

wherein each of the sides of both the base segment and the side panel has a horizontal flange mounted along its top edge, the side panel flanges nesting above the base segment flanges in the nested mode, and in the extended mode a bolt means functions to secure the base segment side flange to the side panel side flange via aligned holes;

wherein the sides of the side panel each have a support strut extending from the flange down to the bottom of the side panel, wherein the support strut and the side it supports can withstand tons of side pressure from a pile of gravel inside the base segment and the extended side panel;

said width W1 large enough to accommodate a skid steer vehicle; and said opposing sides of said base segment and said side panel all having a height of about four feet.

2. The bin of claim 1, wherein the front of the side panel further comprises a folding ramp on its bottom and protective covers on each of its vertical side edges.

3. The bin of claim 1 further comprising a plate under each folding support strut in the extended mode.

4. The bin of claim 1, wherein a depth D1 is chosen to be slightly smaller that a width of a trailer, thereby enabling the bin in the nested mode to fit on the trailer, the bin base segment sides facing front and rear on the trailer.

5. The bin of claim 4 further comprising a chain anchored to the flange on each side of the side panel, thereby enabling a beam extended across the sides, under the chain to lift the nestable bulk storage bin via a forklift.

* * * * *